United States Patent [19]

Lems et al.

[11] 4,228,565

[45] Oct. 21, 1980

[54] STRAP FOR FORMING A READILY DISENGAGEABLE ANTI-REVERSE SEALLESS STRAP CONNECTION

[75] Inventors: Peter Lems, Wilmette; William A. Meier, Hoffman Estates, both of Ill.

[73] Assignee: Signode Corporation, Glenview, Ill.

[21] Appl. No.: 934,497

[22] Filed: Aug. 17, 1978

[51] Int. Cl.[3] ..... B65D 63/02

[52] U.S. Cl. ..... 24/20 EE

[58] Field of Search ..... 24/20 EE, 20 R, 23 EE; 403/393, 375, 315, 316, 283

[56] References Cited

U.S. PATENT DOCUMENTS

| | | | |
|---|---|---|---|
| 161,409 | 3/1875 | Hardman | 24/20 EE |
| 165,407 | 7/1875 | Dawson | 24/22 |
| 203,255 | 5/1878 | Ewing | 24/20 EE |
| 1,378,508 | 5/1921 | Woodward . | |
| 1,936,909 | 11/1933 | MacChesney | 24/20 EE |
| 2,035,351 | 3/1936 | Taylor | 24/20 EE |
| 2,276,988 | 3/1942 | Leslie | 24/20 EE |
| 2,898,673 | 8/1959 | Ericson . | |
| 3,234,610 | 2/1966 | Timmerbeil et al. | 24/20 EE |
| 3,426,392 | 2/1969 | Timmerbeil | 24/20 EE |
| 3,457,599 | 7/1969 | Timmerbeil et al. . | |
| 3,934,918 | 1/1976 | Kress | 24/20 EE X |
| 3,935,616 | 2/1976 | Simmons | 24/20 EE |
| 4,080,689 | 3/1978 | Meier | 24/20 EE |

*Primary Examiner*—Philip C. Kannan

*Attorney, Agent, or Firm*—Dressler, Goldsmith, Shore, Sutker & Milnamow, Ltd.

[57] ABSTRACT

A metal strap segment is provided for forming a loop about compressible material and has a first joint-forming portion on one end and a second joint-forming portion on the other end, each of the joint-forming portions containing an array of longitudinally spaced joint elements which are adapted to interlock to form a sealless strap connection when the joint-forming portions are overlapped. An abutment is provided at the distal end of the second joint-forming portion and a disengageable anti-reverse engaging means, such as a tab or receiving aperture, is provided on the first joint-forming portion. The engaging tab or aperture is located, with respect to the distal end of the first joint-forming portion, inwardly of and adjacent the array of longitudinally spaced joint elements. The engaging tab or aperture is also associated with the inner side of the strap so that when the strap loop is placed about the material and is outwardly bowed, the abutment is forced against the inner side of the first joint-forming portion and is aligned to engage the engaging means to prevent disengagement of the connection when the joint-forming portions are moved relative to each other in a disengaging direction. The connection is easily disengaged, however, by orienting the overlapping joint-forming portions in a generally inwardly bowed position and then displacing one of the joint-forming portions longitudinally relative to the other portion in the disengaging direction.

11 Claims, 22 Drawing Figures

STRAP FOR FORMING A READILY DISENGAGEABLE ANTI-REVERSE SEALLESS STRAP CONNECTION

BACKGROUND OF THE INVENTION

This invention relates to strap segments adapted for forming a loop about material to be tied and for forming a sealless strap connection between overlapping strap ends of the segment. Such strap is typically made of relatively stiff sheet material, i.e., metal strap, and the like.

It is known to provide sealless connections between strap ends in the form of an array of longitudinally spaced joint elements. A common form of such a connection utilizes a central tongue provided with lateral wing extensions partly along the opposite ends of the tongue. Representative prior art patents of this form of joint in this particular field of art are U.S. Pat. Nos. 180,910 to Omstead, 1,606,331 to Anderson, 2,268,339 and 2,276,988 to Leslie, 3,137,047 to Mosey, 3,177,538 to Timmerbeil, and 3,188,706 to Partridge. A form of sealless strap connection wherein a relatively higher strength at the connection is realized and lateral pull out action is avoided, or minimized is taught in U.S. Pat. No. 3,303,541 to Beach.

In many of the aforesaid instances, the connection is maintained only when the joined overlapping ends are kept under tension. If tension is temporarily released on the connection and/or if the overlapped strap ends are longitudinally shifted relative to each other (e.g., if the joint is accidentally bumped), then the connection may be released and the strap ends would separate. Problems of accidental disengagement of the connection are especially significant during the time the strap loop ends are being connected about a compressed bale before the bale is subsequently allowed to expand against the loop.

Various types of sealless strap connection anti-disengagement mechanisms are known. One form of such a sealless strap connection utilizes opposed shoulders displaced from the respective planes of the overlapped lengths of strap which are shaped to interlock with each other and an integral abutment means comprising juxtaposed protuberances shaped to irreversibly override each other while the opposed shoulders are moved into interlocking position and present opposed stops when the shoulders interlock with each other. Such a joint is shown in the U.S. patent to Larry J. Simmons, U.S. Pat. No. 3,935,616.

Sealless strap connections which utilize opposed shoulders displaced from the respective planes of the overlapped lengths of strap which are shaped to interlock with each other, as disclosed in the above-discussed Simmons patent, and which further have anti-disengagement abutment means as an integral part of one or more of the interlocking shoulders are disclosed in the U.S. Pat. No. 4,031,594 to Cepuritis, in the U.S. Pat. No. 4,048,697 to Duenser, and in the U.S. Pat. No. 4,062,086 to Wojcik. All of these patents are assigned to the assignee of the present application.

Other sealless strap connections are known in which some degree of anti-disengagement is effected by specific structures. For example, in the U.S. Pat. No. 161,409 to Hardman an interlocking joint element connection is provided which includes a number of tongues projecting from one strap end and which are received in slots in the other strap end. A reverse tongue is provided to prevent the other connection tongues from springing out of their slots by a sudden pressure or force on the strap.

In the U.S. Pat. No. 203,255 to Ewing, a sealless connection is provided by engaging slots in overlapping ends of a strap loop. Upstanding tongues are provided on each end of the strap for being received in perforations on the other end of the strap to prevent disengagement.

The U.S. Pat. No. 2,035,351 to Taylor shows tongues and receiving slots in overlapping strap end portions, similar to the configuration disclosed in the abovediscussed Ewing patent.

Other forms of sealless strap connections have been devised which prevent, to some degree, disengagement but which are more cumbersome to use than many of the above-described connections. The U.S. Pat. No. 165,407 to Dawson shows a strap segment having apertures on one end for receiving lugs projecting from the other end of the strap. The U.S. Pat. No. 2,276,988 to Leslie, discussed above, discloses an interlocking slit-type joint in which the overlapping strap ends are restrained against reverse movement by the formation of a deformation in the overlapping strap lengths after the strap lengths are interlocked. A special tool is required to create the deformations.

Another type of sealless connection with a lock catch feature which affords some degree of disengagment protection is illustrated in the U.S. Pat. No. 3,426,392 to Timmerbeil. The lock catch is an especially conformed combination of angled slits and is located between two interlocking fastening catches.

In use, a strap segment is typically looped around a material or package to be tied and the sealless connection is formed in the overlapping strap ends. With many types of sealless connections, the strap can be removed from the package or material by disengaging the connected overlapped ends. To do this, the tension in the strap loop must be overcome so that the ends of the strap can be pushed longitudinally relative towards and past each other in the disengaging direction. With such disengageable strap connections, there is a disadvantage. Specifically, when an untensioned strap loop is formed around a compressed package or bale, the loop can be accidentally bumped. This may cause the strap ends to move relative to each other and to become disengaged. Consequently, the various anti-disengagement structures have been developed for such sealless strap connections as set forth in many of the patents discussed above. However, some of the sealless connections that have anti-disengagement structures cannot be easily or readily disengaged by hand. Strap loops connected with such anti-disengagement structures that are not readily disengageable are usually cut or severed when it is desired to release the strap from the bound package or material. Other types of sealless connections with antidisengagement structures do not work as well as desired. Some are difficult to properly assemble, some are difficult to disengage, and some disengage too easily.

It would be beneficial to provide an easily disengageable sealless strap connection with an anti-disengagement structure that would prevent disengagement when the connection was initially being made in a strap loop around a compressed bale before the bale was expanded tight against the strap loop.

It would also be desirable to provide a sealless connection with an anti-reverse or anti-disengagement structure which could be easily disengaged by moving the joint region of the strap loop in a certain manner to render the anti-disengagement structure ineffective prior to moving the overlapping strap loop ends in the disengaging direction.

SUMMARY OF THE INVENTION

A strap having joint elements on each end which are adapted for forming a sealless connection therebetween when the strap is formed in a loop about a compressed package or material is provided with an abutment on one end and a readily disengageable anti-reverse engaging means on the other end. When the strap is first loosely looped and connected around the compressed package, the strap loop becomes outwardly bowed. According to the present invention, the outwardly bowed configuration of the strap loop is advantageously used to inhibit or reduce the possibility of disengagement of the connection until the compression can be relieved and the material expanded tight against the strap loop.

The abutment is formed on the distal end of one of the strap ends, and when the loop is in the outwardly bowed configuration, the abutment is forced outwardly against the inner side of the other, overlapping end, of the strap. The engaging means, such as a tab projecting outwardly from the inside surface of the strap just inwardly of the joint-forming portion of the overlapping strap end, is in alignment with the outwardly forced abutment and can bear against the abutment to prevent disengagement of the connection when the two ends of the strap are moved relative to each other in the disengaging direction.

Should it be desired to disengage the sealless strap connection, the compressible package or material is recompressed, at least in the area of the joint, to provide space between the joint and the surface of the strapped material. Then, a force is applied to the overlapping ends of the strap in the joint area so as to bow the strap loop inwardly at that point. The distal end of the inner strap end (the end adjacent the package and lying between the package and the outer, or overlapping strap end) is thus forced inwardly away from, and out of alignment with, the engaging means and is free to then be moved past the engaging means in the disengaging direction to completely disconnect the joint.

Numerous other advantages and features of the present invention will become readily apparent from the following detailed description of the invention and of one embodiment thereof, from the claims and from the accompanying drawings.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENT

Figure 1:
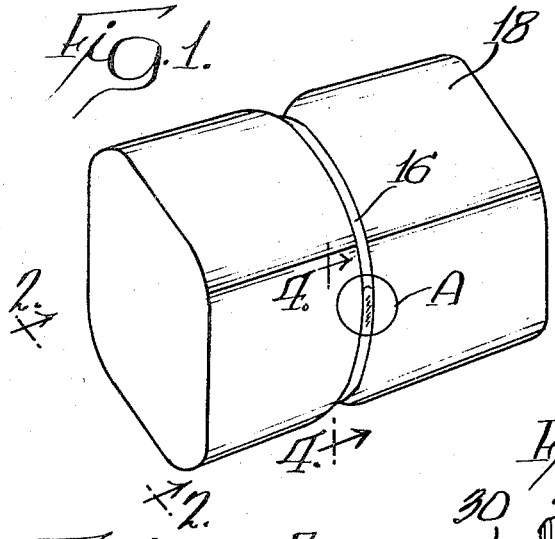
FIG. 1 is a perspective view of a strap of the present invention banded about a bale of previously compressed material which has been allowed to partially expand into engagement with the strap.

While this invention is susceptible of embodiment in many different forms, there are shown in the drawings and will herein be described in detail preferred embodiments of the invention. It should be understood, however, that the present disclosure is to be considered as an exemplification of the principles of the invention and is not intended to limit the invention to the embodiments illustrated.

In the following description, three digit numerals in the 100 series are used to refer to the embodiment illustrated in FIGS. 6 and 6A, three digit numerals in the 200 series are used to refer to the embodiment illustrated in FIGS. 7 and 7A, three digit numerals in the 300 series are used to refer to the embodiment illustrated in FIGS. 8 and 8A, three digit numerals in the 400 series are used to refer to the embodiment illustrated in FIGS. 9 and 9A, three digit numerals in the 500 series are used to refer to the embodiment illustrated in FIGS. 10 and 10A, three digit numerals in the 600 series are used to refer to the embodiment illustrated in FIGS. 11 and 11A, three digit numerals in the 700 series are used to refer to the embodiment illustrated in FIGS. 12 and 12A, and three digit numerals in the 800 series are used to refer to the embodiment illustrated in FIGS. 13, 13A and 13B. The same last two digits in each numeral designate similar or functionally analogous elements in the various embodiments.

A strap or strap segment 16 can be used to tie or band a package or other material 18 as illustrated in FIG. 1. The strap 16 is widely used in the cotton industry to band bales of cotton. For this use, the strap 16 is made of steel and is known in the cotton industry as a bale tie. Typically, when cotten bales are tied with bale ties or metal strap 16, a plurality of straps of ties would be used. However, only one strap 16 is illustrated in FIG. 1 for purposes of simplicity.

Typically, when baling cotton or other relatively compressible material, the strap segment 16 is looped about the bale of compressible material while the material is under compression. The strap 16 is then connected at its ends by a means of interlocking joint elements on each of the overlapping strap ends (diagrammatically indicated within circle A in FIG. 1). Such sealless connection joint elements may be of many types, including some of those described in the patents discussed above in the section entitled "Background of the Invention." However, one type of joint that is advantageously used when strapping compressible bales, such as bales of cotton, is the type disclosed in the aforementioned U.S. Pat. No. 3,303,541 to Beach. Attention is directed to the drawings and specification of that patent for a complete description of a strap having, on each end, longitudinally oriented spaced staggered slits defining and being flanked by complimentary integral web portions of strap offset in opposite normal directions to present lengthwise opposed shoulders which interlock with opposed shoulders of an overlapping strap segment end.

In some strapping applications, such as in the cotton industry, it is desirable to be able to easily disengage the connection for removing the strap from the bale--even for those connections that have an anti-disengagement or anti-reverse feature.

Specifically, in the cotton industry, cotton is frequently baled, in one location, into a relatively low density bale and then shipped to another location for further compression and forming into bales of higher density and smaller physical size. In those situations, the original strap segments or bale ties are too large to be reused on the denser but smaller bale. The original bale ties must be removed and cut shorter or replaced altogether with shorter ties. Removal of the bale ties would be facilitated if the connection, though having an anti-disengagement feature, was easily disengageable by hand manipulation of the strap without requiring the use of special strap severing tools. The present invention provides such a connection.

The present invention provides an easily disengageable anti-reverse sealless connection which makes use of a phenomenon occurring in a strap loop when a strap is looped about a relatively compressible material or package such as cotton bales or the like. This particular phenomenon will first be explained with reference to FIGS. 2, 3, 4, and 5. Following the description of the phenomenon, the specific novel features of the present invention will be described.

Figure 2:
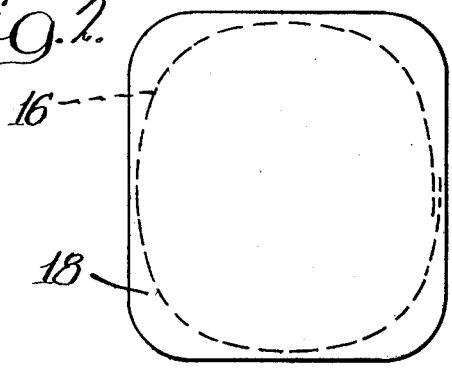
FIG. 2 is an end view of the bale shown in FIG. 1 taken along the plane 2—2 in FIG. 1.
Figure 4:
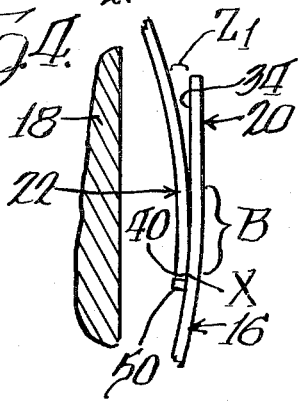
FIG. 4 is an enlarged, partial cross-sectional view of the region designated by circle A in FIG. 3.

Many packages or materials to be tied are somewhat compressible and this is especially true of cotton. Typically, a bale of material 18, such as cotton, is initially compressed, as with press members 30 illustrated in FIG. 3, and the ends of the strap 16 are connected, as at the circled region A in FIG. 3, to form a completed loop. Note that the loop of strap 16 tends to bow outwardly on each side of the bale of material 18. If the connection between the strap ends is made on a side spaced away from the press members 30, as illustrated in FIG. 4, the connection area A is located in an outwardly bowed region of the strap loop and is displaced outwardly from the surface of the bale of material 18. Subsequently, the press members 30 are removed and the bale of material 18 is allowed to expand into engagement with the loop of strap 16. At this point, the loop formed from the strap 16 tends to sink into the material 18 as illustrated in FIG. 2 and to form a loop that has curved corners rather than sharp right angle corners. In perspective, the now strap-restrained bale and strap 16 appear as illustrated in FIG. 1. The region of the joint or connection of the overlapping strap ends in the strap-restrained bale is indicated by the circle A in FIG. 1.

The sealless strap connection of an interlocking joint element type is initially made between the overlapping end portions 20 and 22 of the strap 16 with the bale compressed (as in FIG. 3) so that the strap is bowed outwardly and spaced from the bale surface in the strap connection area. The joint elements are located in the region of the strap indicated by bracket B in FIG. 4, though for purposes of clarity, the detailed structure of the multiple slit configuration is not shown. The multiple slit configuration may be that disclosed in the aforementioned U.S. Pat. No. 3,303,541 to Beach.

When the overlapping strap portions are connected, the outer overlapping joint-forming portion, such as portion 20, will, at its distal end, tend to be displaced outwardly of the other portion of the strap 22 by a distance indicated as $Z_1$ in FIG. 4. The distal end of the strap portion 22 tends to be biased or forced against the inner side surface 34 of the strap at the point X in FIG. 4. With metal strap, the inherent stiffness of the strap causes the distal end of the outer strap portion 20 to remain outwardly displaced by the distance $Z_1$ from the inner strap portion 22.

The above-described bowed configuration of the strap loop, wherein the distal end of one of the strap ends bears against the inside surface of the other overlapping strap end, is advantageously used according to the present invention. For example, as illustrated at point X in FIG. 4, a coacting abutment, such as strap end 40, and an engagement means, such as tab 50, are provided on the overlapping strap segments. The abutment and engagement means are then maintained in an aligned abutting or nearly abutting relationship by the bowed loop configuration. The movement of the strap ends in a joint-disengaging direction will be resisted by the abutment and engagement means as they are forced against each other. This and other specific structures will be described in detail hereinafter, but first it is helpful to discuss how the loop configuration can be altered to allow disengagement of the connection.

Figure 3:
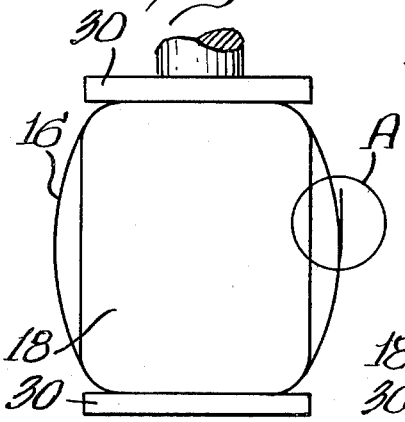
FIG. 3 is a diagrammatic view of the bale in FIG. 1 being compressed by a machine.
Figure 5:
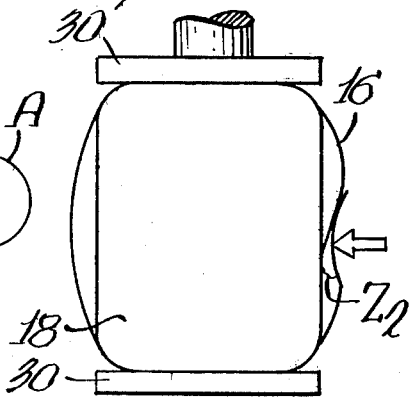
FIG. 5 is a view similar to FIG. 3 showing the joint area of the strap loop of the strap of the present invention being bowed inwardly.

If desired, removal of the strap by disengaging the connection can be accomplished relatively easily. With reference to FIG. 3, it can be seen that when the bale 18 is compressed between press members 30, the strap 16 remains in its generally outwardly bowed configuration and is spaced away from the surface of the bale at one or more sides of the bale. By properly orienting the bale 18 in the press, the joint region A can be located so that the outwardly displaced joint region is readily accessible. Then, according to the present invention, the aligned, coacting abutment and engaging means can be separated, to allow disengagment of the sealless connection, by forcing the joint region of the strap loop inwardly towards the bale 18 as illustrated in FIG. 5 to reverse the loop from a generally outwardly bowed configuration to a generally inwardly bowed configuration wherein the distal end of the inner strap portion 22 is now spaced away from the inner side of the overlapping strap portion 20 by a distance $Z_2$. In this orientation, it is possible to disengage the overlapping strap ends by moving the ends in a joint disengaging direction. In some cases, it may be desirable, when disengaging the connection, to hold or pull outwardly on strap 16 in the region of the tab 50 while pushing inwardly on the overlapping strap portion 20 to cause the strap end 40 to move away from the tab 50. A number of embodiments of the novel disengageable anti-reverse sealless strap connection will next be described.

Figures 6, 6A, 7, 7A, 8, 8A:
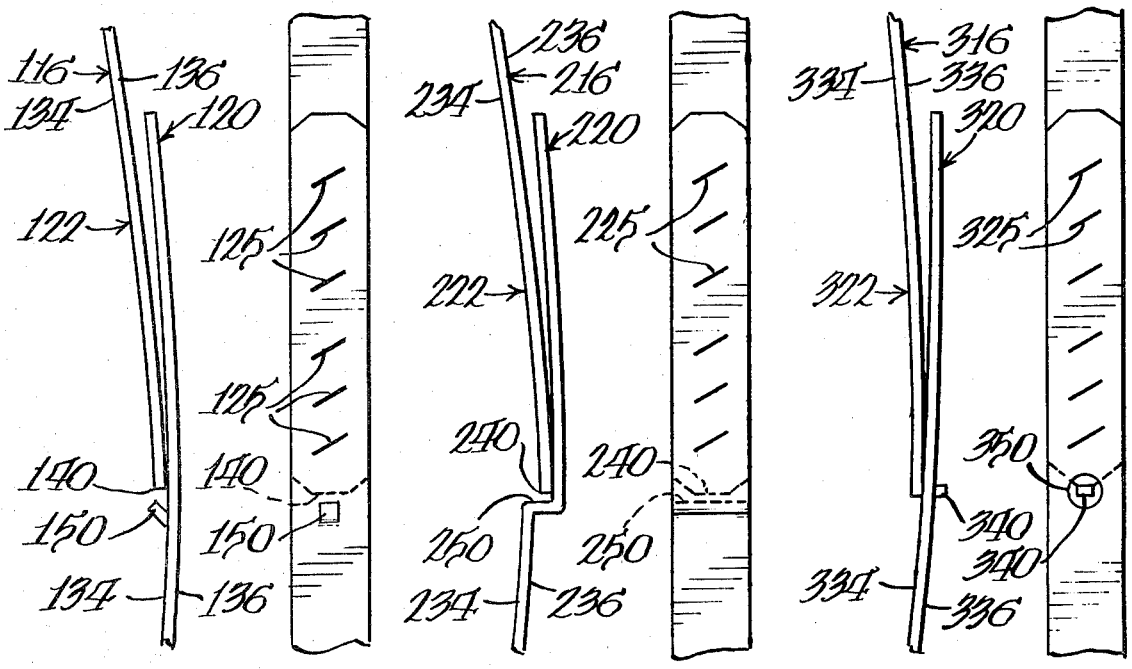
FIGS. 6 and 6A, 7 and 7A, 8 and 8A, 9 and 9A, 10 and 10A, 11 and 11A, 12 and 12A, and 13, 13A and 13B illustrate embodiments 1 through 8, respectively, of the strap improvement according to the present invention wherein each figure shows the sealless connection formed between overlapping lengths of strap.

The first embodiment of the present invention is illustrated in FIGS. 6 and 6A. In those figures, an enlarged view of the overlapping strap portion joint region of a connected strap loop is shown. This region corresponds to the circle A region illustrated in FIG. 3 and to the enlarged view shown in FIG. 4. However, for purposes of simplification in FIGS. 6 and 6A, the bale material, though understood to be adjacent the strap, is not shown.

In the first embodiment, a strap or bale tie 116 is shown having a first joint-forming portion 120 and a second joint-forming portion 122 which are overlapped and interconnected. The joint-forming portions 120 and 122 each contain an array of longitudinally spaced joint elements with the joint elements on one of the portions being adapted to interlock with the joint elements on the other portion for forming a sealless strap connection between the joint portions. The detailed structure of the joint elements is illustrated only diagrammatically in FIG. 6A by the angled lines designated 125. It is to be understood that the actual slit structure may be identical to that disclosed in the above-discussed Beach patent or may be some other suitable structure.

The strap 116 has an inner side 134 adapted to lie against the material to be tied and an outer side 136 opposite the inner side. The distal end of the second joint-forming portion 122 forms an abutment 140 and the first joint-forming portion 120 has, on its inner side 134, a disengageable anti-reverse bale tie engaging means or tab 150 for being aligned with the abutment 140 when the strap is formed into a loop and when the sealless connection is formed between the joint-forming portions 120 and 122.

The engaging means or tab 150 comprises an outwardly projecting lug which is preferably punched from the plane of the strap portion 120 during fabrication of the strap. The tab 150 is associated with the inner side 134 of the strap for engaging the end abutment 140 of the second joint-forming portion 122 to prevent disengagement of the sealless strap connection when the strap loop is placed about the material to be tied and when the loop is outwardly bowed to force the end abutment 140 against the inner side of the first joint-forming portion 120 and adjacent the tab 150. In this way, the anti-reverse bale tie engaging tab 150 is always biased into alignment with the strap end or abutment 140 even though the remaining length of the first joint-forming portion 120 may be spaced outwardly from the second joint-forming portion 122 in the manner previously explained in detail with reference to FIG. 4. In order that the engaging tab 150 be properly aligned with the strap end abutment 140, the engaging means or tab 150 is located, with respect to the distal end of the first joint-forming portion 120, inwardly of, and adjacent the array of longitudinally spaced joint elements 125 on the first joint-forming portion 120.

Depending on the particular design and/or joint element tolerances, the tab 150 and abutment 140 may be in contact or may be slightly spaced apart. In any case, the strap joint becomes bowed so that both tab 150 and abutment 140 are in alignment whereby they will abut if and when the joint-forming portions are moved in a joint disengaging direction.

When it is desired to disengage the sealless connection, the baled material can be compressed so that the overlapping strap end joint area is spaced from the surface of the material. Then, in a manner previously explained with reference to FIG. 5, the strap loop can be moved inwardly from the outwardly bowed position to a generally inwardly bowed position so that the strap end abutment 140 of the second joint-forming portion 122 is spaced away from, and out of alignment with, the tab 150. In this position, displacement of one or both of the joint-forming portions 120 and 122 relative to the other in a longitudinal direction will disengage the connection.

The second embodiment of the present invention is illustrated in FIGS. 7 and 7A which show a strap joint region analogous to that described with reference to FIGS. 6 and 6A above for the first embodiment.

In the second embodiment, a strap or bale tie 216 is shown having a first joint-forming portion 220 and a second joint-forming portion 222 which are overlapped and interconnected. The joint-forming portions 220 and 222 each contain an array of longitudinally spaced joint elements with the joint elements on one of the portions being adapted to interlock with the joint elements on the other portion for forming a sealless strap connection between the joint portions. The detailed structure of the joint elements is illustrated only diagrammatically in FIG. 7A by the angled lines designated 225. It is to be understood that the actual slit structure may be identical to that disclosed in the above-discussed Beach patent or may be some other suitable structure.

The strap 216 has an inner side 234 adapted to lie against the material to be tied and an outer side 236 opposite the inner side. The distal end of the second joint-forming portion 222 forms an abutment 240 and the first joint-forming portion 220 has, on its inner side 234, a disengageable anti-reverse bale tie engaging means or shoulder 250 for being aligned with the abutment 240 when the strap is formed into a loop and when the sealless connection is formed between the joint-forming portions 220 and 222. The shoulder is formed as an integral bend of the strap in the first joint-forming portion 222.

The engaging shoulder 250 is preferably formed in the strap portion 220 during fabrication of the strap. The shoulder 250 is associated with the inner side 234 of the strap for engaging the end abutment 240 of the second joint-forming portion 222 to prevent disengagement of the sealless strap connection when the strap loop is placed about the material to be tied and when the loop is outwardly bowed to force the end abutment 240 against the inner side of the first joint-forming portion 220 and adjacent the shoulder 250. In this way, the anti-reverse bale tie engaging shoulder 250 is always biased into alignment with the strap end or abutment 240 even though the remaining length of the first joint-forming portion 220 may be spaced outwardly from the second joint-forming portion 222 in the manner previously explained in detail with reference to FIG. 4. In order that the engaging shoulder 250 be properly aligned with the strap end abutment 240, the engaging means or shoulder 250 is located, with respect to the distal end of the first joint-forming portion 220, inwardly of, and adjacent the array of longitudinally spaced joint elements 225 on the first joint-forming portion 220.

When it is desired to disengage the sealless connection, the baled material can be compressed so that the overlapping strap end joint area is spaced from the surface of the material. Then, in a manner previously explained with reference to FIG. 5, the strap loop can be moved inwardly from the outwardly bowed position to a generally inwardly bowed position so that the strap end abutment 240 of the second joint-forming portion 222 is spaced away from, and out of alignment with, the shoulder 250. In this position, displacement of one or both of the joint-forming portions 220 and 222 relative to the other in a longitudinal direction will disengage the connection.

The third embodiment of the present invention is illustrated in FIGS. 8 and 8A which show a strap joint region analogous to that described with reference to FIGS. 6 and 6A above for the first embodiment.

In the third embodiment, a strap or bale tie 316 is shown having a first joint-forming portion 320 and a second joint-forming portion 322 which are overlapped and interconnected. The joint-forming portions 320 and 322 each contain an array of longitudinally spaced joint elements with the joint elements on one of the portions being adapted to interlock with the joint elements on the other portion for forming a sealless strap connection between the joint portions. The detailed structure of the joint elements is illustrated only diagrammatically in FIG. 8A by the angled lines designated 325. It is to be understood that the actual slit structure may be identical to that disclosed in the above-discussed Beach patent or may be some other suitable structure.

The strap 316 has an inner side 334 adapted to lie against the material to be tied and an outer side 336 opposite the inner side. The distal end of the second joint-forming portion 322 has an abutment, or projecting tongue 340 and the first joint-forming portion 320 has, on the inner side 334, a disengageable anti-reverse bale tie engaging means, or transverse bearing surface 350, defining a tongue receiving aperture and which surface 350 is aligned with the tongue 340 when the strap is formed into a loop and when the sealless connection is formed between the joint-forming portions 320 and 322.

The engaging bearing surface 350 is preferably formed in the strap during fabrication of the strap. The surface 350 is associated with, and communicates with, the inner side 334 of the strap for being aligned with the tongue 340 of the second joint-forming portion 322 to prevent disengagement of the sealless strap connection when the strap loop is placed about the material to be tied and when the loop is outwardly bowed to force the tongue 340 against the inner side of the first joint-forming portion 320 and adjacent the aperture bearing surface 350. In this way, the anti-reverse bale tie engaging surface 350 is always biased into alignment with the tongue 340 even though the remaining length of the first joint-forming portion 320 may be spaced outwardly from the second joint-forming portion 322 in the manner previously explained in detail with respect to FIG. 3. In order that the engaging surface 350 be properly aligned with the tongue 340, the engaging means or surface 350 is located, with respect to the distal end of the first joint-forming portion 320, inwardly of, and adjacent the array of longitudinally spaced joint elements 325 on the first joint-forming portion 320.

When it is desired to disengage the sealless connection, the baled material can be compressed so that the overlapping strap end joint area is spaced from the surface of the material. Then, in a manner previously explained with reference to FIG. 5, the strap loop can be moved inwardly from the outwardly bowed position to a generally inwardly bowed position so that the tongue 340 of the second joint-forming portion 322 is spaced away from, and out of alignment with, the aperture bearing surface 350. In this position, displacement of one or both of the joint-forming portions 320 and 322 relative to the other in a longitudinal direction will disengage the connection.

Figure 9:
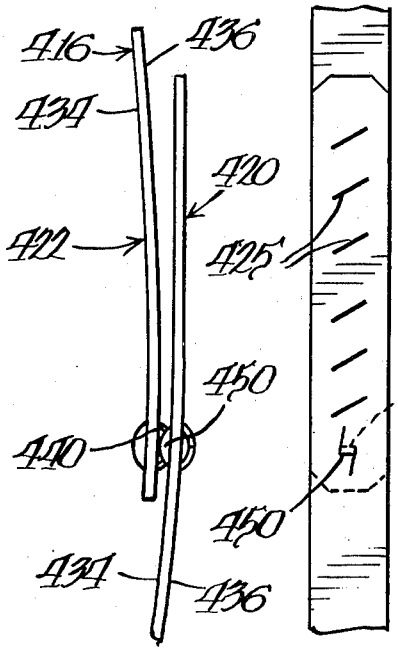
Figure 9A:
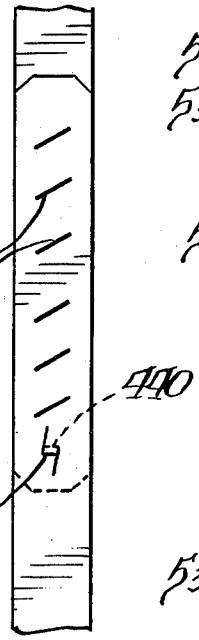

The fourth embodiment of the present invention is illustrated in FIGS. 9 and 9A which show a strap joint region analogous to that described with reference to FIGS. 6 and 6A above for the first embodiment.

In the fourth embodiment, a strap or bale tie 416 is shown having a first joint-forming portion 420 and a second joint-forming portion 422 which are overlapped and interconnected. The joint-forming portions 420 and 422 each contain an array of longitudinally spaced joint elements with the joint elements on one of the portions being adapted to interlock with the joint elements on the other portion for forming a sealless strap connection between the joint portions. The detailed structure of the joint elements is illustrated only diagrammatically in FIG. 9A by the angled lines designated 425. It is to be understood that the actual slit structure may be identical to that disclosed in the above-discussed Beach patent or may be some other suitable structure.

The strap 416 has an inner side 434 adapted to lie against the material to be tied and an outer side 436 opposite the inner side. On the end of the second joint-forming portion 422 there is an abutment, upstanding tab or shoulder 440 and on the inner side of the first joint-forming portion 420 there is a disengageable anti-reverse bale tie engaging means or upstanding shoulder 450 for being aligned with the shoulder 440 when the strap is formed into a loop and when the sealless connection is formed between the joint-forming portions 420 and 422. Both shoulders 440 and 450 are essentially identical, but oppositely facing and are each defined by three connecting slits such as slits 425 in portion 420. This shape of an anti-disengagement shoulder is disclosed in detail in the aforementioned U.S. Pat. No. 3,935,616 to Simmons and attention is directed thereto. However, in the Simmons patent, the anti-disengagement shoulders are shown in the middle of the array of joint elements and thus, do not take advantage of the biasing effect of the outwardly bowed configuration and cannot be easily disengaged as provided by the present invention. Specifically, in the present invention, the shoulder 450 is associated with the inner side 434 of the strap for aligning with the shoulder 440 of the second joint-forming portion 422 to prevent disengagement of the sealless strap connection when the strap loop is placed about the material to be tied and when the loop is outwardly bowed to force the shoulder 440 against the inner side of the first joint-forming portion 420 and adjacent the shoulder 450. In this way, the anti-reverse bale tie engaging shoulder 450 is always biased into alignment with the shoulder 440 even though the remaining length of the first joint-forming portion 420 may be spaced outwardly from the second joint-forming portion 422 in the manner previously explained in detail with respect to FIG. 4. In order that the engaging shoulder 450 be properly aligned with the abutment shoulder 440, the engaging means or shoulder 450 is located, with respect to the distal end of the first joint-forming portion 420, inwardly of, and adjacent the array of longitudinally shaped joint elements 425 on the first joint-forming portion 420.

When it is desired to disengage the sealless connection, the baled material can be compressed so that the overlapping strap end joint area is spaced from the surface of the material. Then, in a manner previously explained with reference to FIG. 5, the strap loop can be moved inwardly from the outwardly bowed position to a generally inwardly bowed position so that the strap end abutment shoulder 440 of the second joint-forming portion 422 is spaced away from, and out of alignment with, the shoulder 450. In this position, displacement of one or both of the joint-forming portions 420 and 422 relative to the other in a longitudinal direction will disengage the connection.

Figure 10:
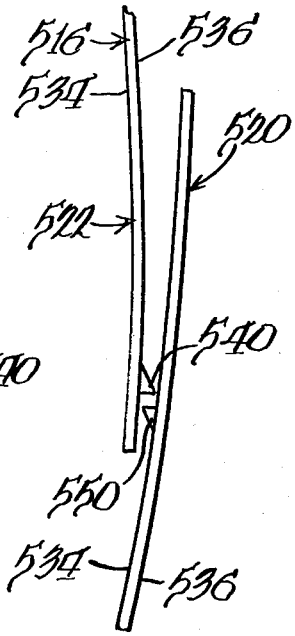
Figure 10A:
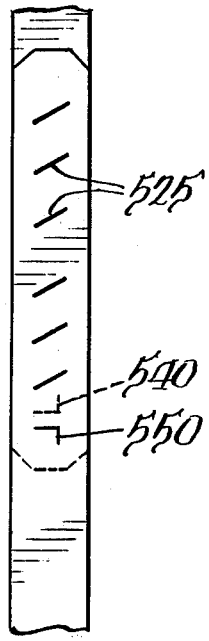

The fifth embodiment of the present invention is illustrated in FIGS. 10 and 10A which show a strap joint region analogous to that described with reference to FIGS. 6 and 6A above for the first embodiment.

In the fifth embodiment, a strap or bale tie 516 is shown having a first joint-forming portion 520 and a second joint-forming portion 522 which are overlapped and interconnected. The joint-forming portions 520 and 522 each contain an array of longitudinally spaced joint elements with the joint elements on one of the portions being adapted to interlock with the joint elements on the other portion for forming a sealless strap connection between the joint portions. The detailed structure of the joint elements is illustrated only diagrammatically in FIG. 9A by the angled lines designated 525. It is to be understood that the actual slit structure may be identical to that disclosed in the above-discussed Beach patent or may be some other suitable structure.

The strap 516 has an inner side 534 adapted to lie against the material to be tied and an outer side 536 opposite the inner side. The distal end of the second joint-forming portion 522 has an abutment tab 540 near the distal end thereof and the first joint-forming portion 520 has, on the inner side 534, a disengageable anti-reverse bale tie engaging means or tab 550 for being aligned with the abutment tab 540 when the strap is formed into a loop and when the sealless connection is formed between the joint-forming portions 520 and 522.

Both the tab 540 and the tab 550 are defined by two connected slits disposed in the strap at generally right angles to each other to define a "corner"-shaped tab. The tabs 540 and 550 are preferably punched from the plane of the strap during fabrication of the strap. The tabs 540 and 550 are associated with, and project from, the strap outer side 536 and the strap inner side 534, respectively. This permits tab 540 of the second joint-forming portion 522 to prevent disengagement of the sealless strap connection when the strap loop is placed about the material to be tied and when the loop is outwardly bowed to force tab 540 against the inner side of the first joint-forming portion 520 and adjacent the tab 550. In this way, the anti-reverse bale tie engaging tab 550 is always biased into alignment with the tab 540 even though the remaining length of the first joint-forming portion 520 may be spaced outwardly from the second joint-forming portion 522 in the manner previously explained in detail with respect to FIG. 4. In order that the engaging tab 550 be properly aligned with the strap end abutment 540, the engaging means or tab 550 is located, with respect to the distal end of the first joint-forming portion 520, inwardly of, and adjacent the array of longitudinally spaced joint elements 525 on the first joint-forming portion 520.

When it is desired to disengage the sealless connection, the baled material can be compressed so that the overlapping strap end joint area is spaced from the surface of the material. Then, in a manner previously explained with reference to FIG. 5, the strap loop can be moved inwardly from the outwardly bowed position to a generally inwardly bowed position so that the tab 540 of the second joint-forming portion 522 is spaced away from, and out of alignment with, the tab 550. In this position, displacement of one or both of the joint-forming portions 520 and 522 relative to the other in a longitudinal direction will disengage the connection.

Figure 11:
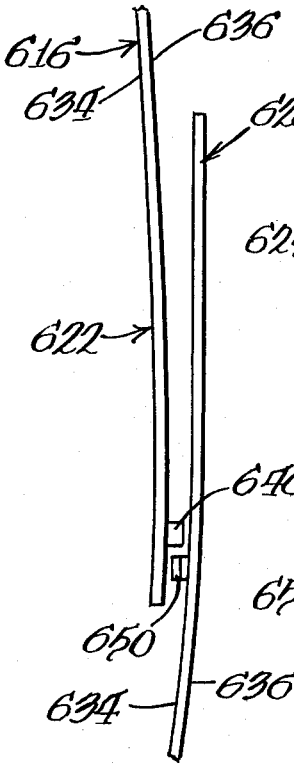
Figure 11A:
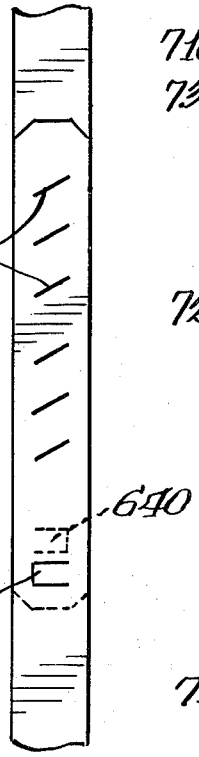

The sixth embodiment of the present invention is illustrated in FIGS. 11 and 11A which show a strap joint region analogous to that described with reference to FIGS. 6 and 6A above for the first embodiment.

In the sixth embodiment, a strap or bale tie 616 is shown having a first joint-forming portion 620 and a second joint-forming portion 622 which are overlapped and interconnected. The joint-forming portions 620 and 622 each contain an array of longitudinally spaced joint elements with the joint elements on one of the portions being adapted to interlock with the joint elements on the other portion for forming a sealless strap connection between the joint portions. The detailed structure of the joint elements is illustrated only diagrammatically in FIG. 11A by the angled lines designated 625. It is to be understood that the actual slit structure may be identical to that disclosed in the above-discussed Beach patent or may be some other suitable structure.

The strap 616 has an inner side 634 adapted to lie against the material to be tied and an outer side 636 opposite the inner side. The distal end of the second joint-forming portion 622 has an abutment tab 640 projecting from the strap outer side 636 and the first joint-forming portion 620 has, on the inner side 634, a disengageable anti-reverse bale tie engaging means or tab 650 for being aligned with the abutment tab 640 when the strap is formed into a loop and when the sealless connection is formed between the joint-forming portions 620 and 622.

Each tab 640 and 650 is a generally outwardly projecting, square-shaped piece of strap metal which has three sides defined by slits and a fourth side merging with the plane of the strap. Preferably, the tabs are oppositely facing as illustrated.

The tabs 640 and 650 are preferably punched from the plane of the strap during fabrication of the strap. The tab 650 is associated with the inner side 634 of the strap for being aligned with the abutment tab 640 of the second joint-forming portion 622 to prevent disengagement of the sealless strap connection when the strap loop is placed about the material to be tied and when the loop is outwardly bowed to force the abutment 640 adjacent the inner side of the first joint-forming portion 620 and against the tab 650. In this way, the anti-reverse bale tie engaging tab 650 is always biased into alignment with the tab 640 even though the remaining length of the first joint-forming portion 620 may be spaced outwardly from the second joint-forming portion 622 in the manner previously explained in detail with respect to FIG. 4. In order that the engaging tab 650 be properly aligned with the strap end abutment 640, the engaging means or tab 650 is located, with respect to the distal end of the first joint-forming portion 620, inwardly of, and adjacent the array of longitudinally spaced joint elements 625 on the first joint-forming portion 620.

When it is desired to disengage the sealless connection, the baled material can be compressed so that the overlapping strap end joint area is spaced from the surface of the material. Then, in a manner previously explained with reference to FIG. 5, the strap loop can be moved inwardly from the outwardly bowed position to a generally inwardly bowed position so that the tab 640 of the second joint-forming portion 622 is spaced away from, and out of alignment with, the tab 650. In this position, displacement of one or both of the joint-forming portions 620 and 622 relative to the other in a longitudinal direction will disengage the connection.

Figure 12:
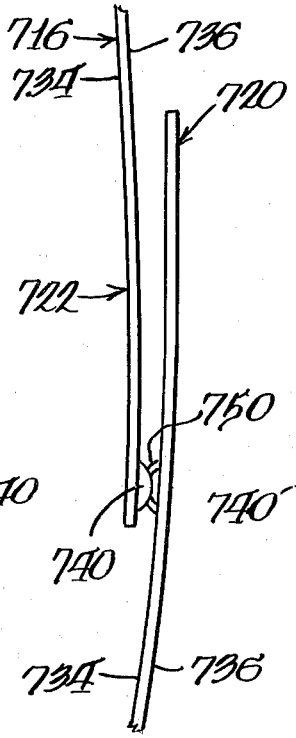
Figure 12A:
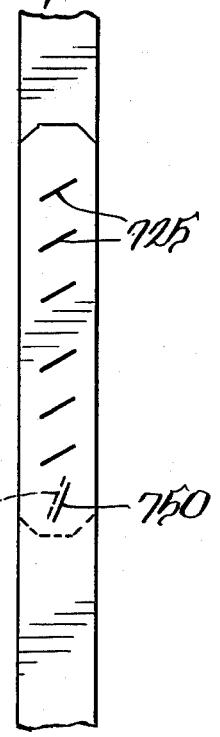

The seventh embodiment of the present invention is illustrated in FIGS. 12 and 12A which show a strap joint region analogous to that described with reference to FIGS. 6 and 6A above for the first embodiment.

In the seventh embodiment, a strap or bale tie 716 is shown having a first joint-forming portion 720 and a second joint-forming portion 722 which are overlapped and interconnected. The joint-forming portions 720 and 722 each contain an array of longitudinally spaced joint elements with the joint elements on one of the portions being adapted to interlock with the joint elements on the other portion for forming a sealless strap connection between the joint portions. The detailed structure of the joint elements is illustrated only diagrammatically in FIG. 12A by the angled lines designated 725. It is to be understood that the actual slit structure may be identical to that disclosed in the above-discussed Beach patent or may be some other suitable structure.

The strap 716 has an inner side 734 adapted to lie against the material to be tied and an outer side 736 opposite the inner side. The distal end of the second joint-forming portion 722 presents an angled abutment shoulder 740 projecting from the outer side 736. The first joint-forming portion 720 has, on the inner side 734, a disengageable anti-reverse bale tie engaging means or angled shoulder 750 for being aligned with the shoulder 740 when the strap is formed into a loop and when the sealless connection is formed between the joint-forming portions 720 and 722. The shoulders 740 and 750 are essentially identical but oppositely facing and are each defined by one angled slit in the strap. Each shoulder is formed by a raised portion or "hump" of strap on one side of the slit. The strap area on the other side of the slit may be flat or may be "humped" out of the plane of the strap in the opposite direction.

The angled shoulder 750 is associated with the inner side 734 of the strap for aligning with the shoulder 740 of the second joint-forming portion 722 to prevent disengagement of the sealless strap connection when the strap loop is placed about the material to be tied and when the loop is outwardly bowed to force the shoulder 740 against the inner side of the first joint-forming portion 720 and adjacent shoulder 750. In this way, the anti-reverse bale tie engaging shoulder 750 is always biased into alignment with the shoulder 740 even though the remaining length of the first joint-forming portion 720 may be spaced outwardly from the second joint-forming portion 722 in the manner previously explained in detail with respect to FIG. 4. In order that the engaging shoulder 750 be properly aligned with the abutment shoulder 740, the engaging shoulder 750 is located, with respect to the distal end of the first joint-forming portion 720, inwardly of, and adjacent the array of longitudinally spaced joint elements 725 on the first joint-forming portion 720.

When it is desired to disengage the sealless connection, the baled material can be compressed so that the overlapping strap end joint area is spaced from the surface of the material. Then, in a manner previously explained with reference to FIG. 5, the strap loop can be moved inwardly from the outwardly bowed position to a generally inwardly bowed position so that the abutment shoulder 740 of the second joint-forming portion 722 is spaced away from, and out of alignment with, the shoulder 750. In this position, displacement of one or both of the joint-forming portions 720 and 722 relative to the other in a longitudinal direction will disengage the connection.

Figure 13:
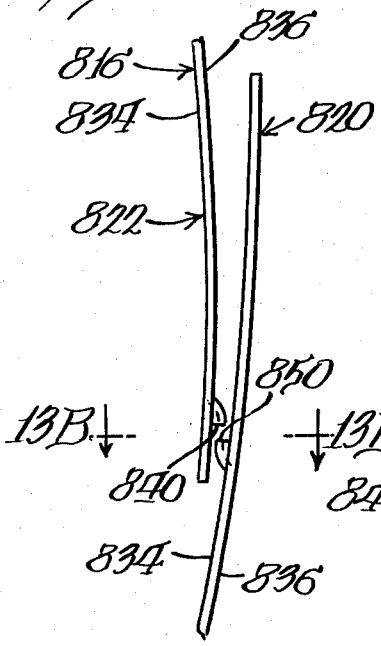
Figure 13A:
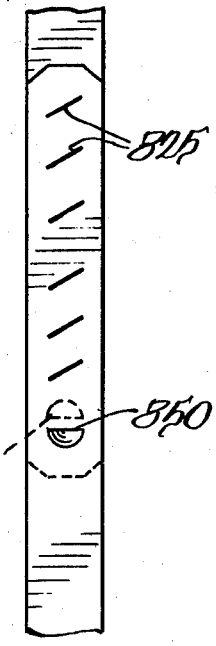
Figure 13B:
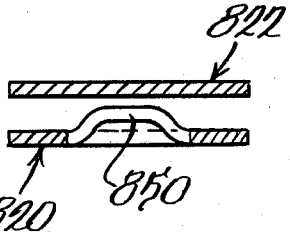

The eighth embodiment of the present invention is illustrated in FIGS. 13, 13A and 13B which show a strap joint region analogous to that described in FIGS. 6 and 6A above for the first embodiment.

In the eighth embodiment, a strap or bale tie 816 has a first joint-forming portion 820 and a second joint-forming portion 822 which are overlapped and interconnected. The joint-forming portions 820 and 822 each contain an array of longitudinally spaced joint elements with the joint elements on one of the portions being adapted to interlock with the joint elements on the other portion for forming a sealless strap connection between the joint portions. The detailed structure of the joint elements is illustrated only diagrammatically in FIG. 13A by the angled lines designated 825. It is to be understood that the actual slit configuration may be identical to that disclosed in the above-discussed Beach patent or may be some other suitable structure.

The strap 816 has an inner side 834 adapted to lie against the material to be tied and an outer side 836 opposite the inner side. The distal end of the second joint-forming portion 822 has an abutment or cross-sectional portion 840 raised from the plane of the strap and projecting from the outer side 836. The first joint-forming portion has, on the inner side 834, a disengageable anti-reverse bale tie engaging means or raised cross-sectional portion 850 for being aligned with the portion 840 when the strap is formed into a loop and when the sealless connection is formed between the joint-forming portions 820 and 822.

The raised portions 840 and 850 are essentially identical but oppositely facing and are each defined by a single slit across part of the strap. As best viewed in FIG. 13B for raised portion 850, the portions are seen to be in the form of a "louver" or a generally U-shaped deformation in the strap. These deformations have no sharp corners which could snag or catch other parts of the strap or material to be tied. Further, the lack of the corners or sharp edges is obviously advantageous with respect to personnel safety.

The raised portion 850 is associated with the inner side 834 of the strap for aligning with the raised portion 840 of the second joint-forming portion 822 to prevent disengagement of the sealless strap connection when the strap loop is placed about the material to be tied and when the loop is outwardly bowed to force the raised portion 840 against the inner side of the first joint-forming portion 820 and adjacent the oppositely facing portion 850.

When it is desired to disengage the sealless connection, the baled material can be compressed so that the overlapping strap end joint area is spaced from the surface of the material. Then, in a manner previously explained with reference to FIG. 5, the strap loop can be moved inwardly from the outwardly bowed position to a generally inwardly bowed position so that the raised portion 840 of the second joint-forming portion 822 is spaced away from, and out of alignment with, the raised portion 850. In this position, displacement of one or both of the joint-forming portions 820 and 822 relative to the other in a longitudinal direction will disengage the connection.

The use of the louver-shaped raised portions 840 and 850 described and illustrated with respect to FIGS. 13, 13A, and 13B has a novel advantage with respect to reusing a strap segment containing such a structure. Specifically, it is sometimes desired to strap a large bale of material with a predetermined, large length of strap and then to subsequently disengage the large strap from the bale, sever the strap at one or more places to form a smaller strap segment, and to then use the smaller strap segment to bind a smaller bale.

In the past, strap structures have been disclosed wherein the smaller strap segment is designated on a larger strap segment by one or more indicia, for example, by diamond-shaped apertures. The strap can be broken by bending the strap at the aperture(s) to form the smaller strap segment. Such a strap structure is disclosed in the U.S. application of Meier, Ser. No. 689,075.

The Meier application discloses a primary strap segment provided with an integrally formed smaller strap segment for forming a second smaller loop and for forming a sealless strap connection between overlapping strap ends of the smaller segment when the smaller segment is severed from the larger segment. According to the Meier application, the strap may be broken, as by bending, at a diamond-shaped aperture. Depending on the strap metal used, a burr is sometimes formed at the broken end(s) of the strap. The burr can snag or catch on adjacent strap or bound material and may, in some cases, prevent a joint from being made properly with the smaller strap segment.

With the strap of the present invention, it has been found that the raised portions of the strap, 840 and 850, can be used as indicia for strap severance in the same manner as the diamond-shaped apertures disclosed in the Meier application. When the strap is bent and broken at the slit defining each raised portion, there is surprisingly little tendency for a burr to be formed.

With a strap having diamond-shaped aperture indicia, as disclosed in the above-mentioned Meier application, it is not always possible to consistently break the strap to form a smaller segment of a precise length. That is, in practice, there is a slight variation in the length of the smaller strap segments after they are broken from the large straps at the diamond-shaped aperture(s). It has been found that straps of the present invention having the novel disengageable anti-reverse, raised portions (840 and 850 in FIG. 13) can be broken at those raised portions, along the slits which define the raised portions, to yield smaller strap segments having less variation in length than can be achieved with straps that are broken at diamond-shaped apertures.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. In a bale tie of the type comprising a generally flat metal strap adapted for forming a loop about compressible material and having a first joint-forming portion on one end and a second joint-forming portion on the other end, said joint-forming portions each containing an array of longitudinally spaced joint elements, said joint elements on one of said portions being adapted to interlock with the joint elements on the other portion for forming a sealless strap connection when the joint-forming portions are overlapped with said second joint-forming portion lying between said material and said first joint-forming portion, said strap further having an inner side adapted to lie against said material and an outer side opposite the inner side, the improvement comprising:

an abutment depending from said outer side of said strap on said second joint-forming portion and a disengageable anti-reverse bale tie engaging means on said first joint-forming portion for aligning with said abutment on said second joint-forming portion when said strap is formed into a loop and when said sealless connection is formed between said joint-forming portions, said abutment being located on said second joint-forming portion outwardly of and adjacent the array of all of the longitudinally spaced joint elements, said engaging means located at said inner side of said strap inwardly of and adjacent the array of all of the longitudinally spaced joint elements for aligning with said abutment on said second joint-forming portion when the connected strap loop is placed about said material and is outwardly bowed to force said abutment against the inner side of said first portion and adjacent said engaging means whereby, when the joint-forming portions are moved relative to each other in a disengaging direction, said abutment bears against said engaging means and disengagement of the connection is prevented, said connection being easily disengaged, however, by orienting said overlapped and connected joint-forming portions of said strap in a generally inwardly bowed configuration and then displacing one of said portions longitudinally relative to the other portion in the disengaging direction.

2. The improvement in accordance with claim 1 wherein said engaging means includes a protuberance on the inner side of said strap and in which said abutment on said second joint-forming portion includes the distal end of said strap.

3. The improvement in accordance with claim 1 wherein said engaging means includes a shoulder defined by a bend in said first joint-forming portion inwardly of and adjacent said array of longitudinally spaced joint elements and in which said abutment on said second joint-forming portion includes the distal end of said strap.

4. The improvement in accordance with claim 1 wherein said engaging means is a transverse bearing surface in said strap defining a hole therein at said inner side and wherein said abutment on said second portion includes a tab projecting outwardly from said outer side surface of said strap and adapted to be received within said hole for being engaged by said bearing surface.

5. The improvement in accordance with claim 1 in which said engaging means and said abutment are oppositely facing, angled, projecting shoulders, each of said shoulders defined by one angled slit in the strap and formed by the raised portion of the strap on one side of the slit.

6. The improvement in accordance with claim 1 in which said engaging means and said abutment are oppositely facing cross sections of strap portions raised from the plane of the strap, each cross section defined by a single transverse slit, each said slit serving as a strap severance index whereby said strap may be bent and broken at said slit to yield a smaller strap segment of predetermined length.

7. In a bale tie of the type comprising a generally flat metal strap adapted for forming a loop about compressible material and having a first joint-forming portion on one end and a second joint-forming portion on the other end, said joint-forming portions each containing an array of longitudinally spaced joint elements, said joint elements on one of said portions being adapted to interlock with the joint elements on the other portion for forming a sealless strap connection when the joint-forming portions are overlapped with said second joint-forming portion lying between said material and said first joint-forming portion, said strap further having an inner side adapted to lie against said material and an outer side opposite the inner side, the improvement comprising:

an abutment shoulder on said second joint-forming portion projecting from said outer side of said strap and a disengageable anti-reverse bale tie engaging shoulder on said first joint-forming portion projecting from said inner side of said strap for aligning with said abutment shoulder on said second joint-forming portion when said strap is formed into a loop and when said sealless connection is formed between said joint-forming portions, each of said shoulders defined by three connecting slits in said strap, said abutment shoulder being located on said second joint-forming portion outwardly of and adjacent the array of all of the longitudinally spaced joint elements, said engaging shoulder located at said inner side of said strap inwardly of and adjacent the array of all of the longitudinally spaced joint elements for aligning with said abutment shoulder on said second joint-forming portion when the connected strap loop is placed about said material and is outwardly bowed to force said abutment against the inner side of said first portion and adjacent said engaging shoulder whereby, when the joint-forming portions are moved relative to each other in a disengaging direction, said abutment shoulder bears against said engaging shoulder and disengagement of the connection is prevented, said connection being easily disengaged, however, by orienting said overlapped and connected joint-forming portions of said strap in a generally inwardly bowed configuration and then displacing one of said portions longitudinally relative to the other portion in the disengaging direction.

8. In a bale tie of the type comprising a generally flat metal strap adapted for forming a loop about compressible material and having a first joint-forming portion on one end and a second joint-forming portion on the other end, said joint-forming portions each containing an array of longitudinally spaced joint elements, said joint elements on one of said portions being adapted to interlock with the joint elements on the other portion for forming a sealless strap connection when the joint-forming portions are overlapped with said second joint-forming portion lying between said material and said first joint-forming portion, said strap further having an inner side adapted to lie against said material and an outer side opposite the inner side, the improvement comprising:

an abutment tab projecting outwardly from said outer side of said strap on said second joint-forming portion and a disengageable anti-reverse bale tie engaging tab on said first joint-forming projecting from said inner side of said strap for aligning with said abutment tab on said second joint-forming portion when said strap is formed into a loop and when said sealless connection is formed between said joint-forming portions, said abutment tab being located on said second joint-forming portion outwardly of and adjacent the array of all the longitudinally spaced joint elements, said engaging tab located at said inner side of said strap inwardly of and adjacent the array of all of the longitudinally spaced joint elements for aligning with said abutment tab on said second joint-forming portion when the connected strap loop is placed about said material and is outwardly bowed to force said abutment tab against the inner side of said first portion and adjacent said engaging tab whereby, when the joint-forming portions are moved relative to each other in a disengaging direction, said abutment tab bears against said engaging tab and disengagement of the connection is prevented, said connection being easily disengaged, however, by orienting said overlapped and connected joint-forming portions of said strap in a generally inwardly bowed configuration and then displacing one of said portions longitudinally relative to the other portion in the disengaging direction.

9. The improvement in accordance with claim 8 in which each of said tabs is defined by two connected slits in the strap at generally right angles to each other to define a corner-shaped tab with the corner of the tab projecting outwardly from a surface of the strap.

10. The improvement in accordance with claim 8 in which each of said tabs is a generally square-shaped piece of strap metal projecting from the strap surface and which has three sides defined by slits and a fourth side merging with the plane of the strap.

11. An easily disengageable anti-reverse sealless strap connection between overlapped lengths of strap, which strap is adapted to be formed into an outwardly bowed loop about compressible material and has an inner side lying against said material and an outer side opposite the inner side, which strap further has a first joint-forming portion on one end and a second joint-forming portion on the other end, said second joint-forming portion lying between said material and said first joint-forming portion, the distal end of said second joint-forming portion being biased outwardly against the inner side of said first portion, said joint comprising:

an array of longitudinally spaced interlocking joint elements on each said first and second joint-forming portion;

an abutment depending from said outer side of said strap on said second joint-forming portion, said abutment being located on said second joint-forming portion outwardly of and adjacent the array of all of the longitudinally spaced joint elements; and a disengageable anti-reverse bale tie engaging means at said inner side of said strap on said first joint-forming portion, said engaging means being located on said first joint-forming portion inwardly of and adjacent the array of all of the longitudinally spaced joint elements for aligning with said abutment on said second joint-forming portions as the abutment is biased outwardly against the inner side of said first joint-forming portion and adjacent said engaging means to prevent disengagement of the connection, whereby said connection is easily disengaged by orienting said overlapped joint-forming portions in a generally inwardly bowed configuration and then displacing one of said portions longitudinally relative to the other portion in the disengaging direction.

* * * * *

UNITED STATES PATENT AND TRADEMARK OFFICE

CERTIFICATE OF CORRECTION

PATENT NO. : 4,228,565

DATED : October 21, 1980

INVENTOR(S) : Lems et al.

It is certified that error appears in the above-identified patent and that said Letters Patent are hereby corrected as shown below:

Column 2, line 11, "abovedis" should be --above dis- --.

Column 2, line 45, "can" should be --could--.

Column 2, line 45, "may" should be --may--.

Column 2, line 57, "antidisengagement" should be --anti-disengagement--.

Column 4, line 45, "cotten" should be --cotton--.

Column 4, line 46, "straps of ties" should be --straps or ties--.

Signed and Sealed this

Third Day of March 1981

[SEAL]

*Attest:*

RENE D. TEGTMEYER

*Attesting Officer*

*Acting Commissioner of Patents and Trademarks*